US009328573B2

(12) United States Patent
Standifird et al.

(10) Patent No.: US 9,328,573 B2
(45) Date of Patent: May 3, 2016

(54) INTEGRATED GEOMECHANICS DETERMINATIONS AND WELLBORE PRESSURE CONTROL

(75) Inventors: William Bradley Standifird, Richmond, TX (US); Syed AiJaz Rizvi, Sugar Land, TX (US); Xiaomin Hu, Missouri City, TX (US); James R. Lovorn, Tomball, TX (US); Sara Shayegi, Houston, TX (US); Nancy Davis, Arlington, TX (US); Jeremy Greenwood, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 744 days.

(21) Appl. No.: 13/144,321

(22) PCT Filed: Oct. 5, 2009

(86) PCT No.: PCT/US2009/059545
§ 371 (c)(1),
(2), (4) Date: Aug. 17, 2011

(87) PCT Pub. No.: WO2011/043764
PCT Pub. Date: Apr. 14, 2011

(65) Prior Publication Data
US 2011/0290562 A1 Dec. 1, 2011

(51) Int. Cl.
*E21B 21/08* (2006.01)

(52) U.S. Cl.
CPC ..... *E21B 21/08* (2013.01)

(58) Field of Classification Search
CPC ..... E21B 21/08; E21B 44/00
USPC ..... 175/24, 25, 38, 48
See application file for complete search history.

(56) References Cited

U.S. PATENT DOCUMENTS 3,479,001 A 11/1969 Dower
4,393,350 A 7/1983 Hansen et al.
(Continued)

FOREIGN PATENT DOCUMENTS

CN 101037941 A 9/2007
WO 2009062716 A2 5/2009
(Continued)

OTHER PUBLICATIONS

International Search Report with Written Opinion issued Nov. 30, 2009 for International Patent Application No. PCT/US09/059534, 8 pages.
(Continued)

*Primary Examiner* — William P Neuder
(74) *Attorney, Agent, or Firm* — Chamberlain Hrdlicka

(57) ABSTRACT

Well pressure control is integrated in real time with geomechanics determinations made during drilling. A well drilling method includes updating determinations of properties of a formation surrounding a wellbore in real time as the wellbore is being drilled; and controlling wellbore pressure in real time as the wellbore is being drilled, in response to the updated determinations of the formation properties. Another well drilling method includes obtaining sensor measurements in a well drilling system in real time as a wellbore is being drilled; transmitting the sensor measurements to a control system in real time; the control system determining in real time properties of a formation surrounding the wellbore based on the sensor measurements, and the control system transmitting in real time a pressure setpoint to a controller; and the controller controlling operation of at least one flow control device, thereby influencing a well pressure toward the pressure setpoint.

18 Claims, 3 Drawing Sheets

(56) References Cited

U.S. PATENT DOCUMENTS

| | | | | |
|---|---|---|---|---|
| 4,596,143 | A | 6/1986 | Norel | |
| 4,940,943 | A | 7/1990 | Bartel et al. | |
| 5,050,690 | A * | 9/1991 | Smith | 175/50 |
| 5,095,273 | A | 3/1992 | Kennedy et al. | |
| 5,160,925 | A | 11/1992 | Dailey et al. | |
| 5,235,285 | A | 8/1993 | Clark et al. | |
| 5,339,036 | A | 8/1994 | Clark et al. | |
| 5,501,285 | A | 3/1996 | Lamine et al. | |
| 5,508,616 | A | 4/1996 | Sato et al. | |
| 5,568,838 | A | 10/1996 | Struthers et al. | |
| 5,726,951 | A | 3/1998 | Birchak et al. | |
| 5,984,023 | A | 11/1999 | Sharma et al. | |
| 6,006,844 | A | 12/1999 | Van Puymbroeck et al. | |
| 6,176,323 | B1 | 1/2001 | Weirich et al. | |
| 6,181,138 | B1 | 1/2001 | Hagiwara et al. | |
| 6,220,371 | B1 | 4/2001 | Sharma et al. | |
| 6,374,925 | B1 | 4/2002 | Elkins et al. | |
| 6,457,538 | B1 | 10/2002 | Pittard et al. | |
| 6,480,118 | B1 | 11/2002 | Rao | |
| 6,778,127 | B2 | 8/2004 | Stolarczyk et al. | |
| 6,788,066 | B2 | 9/2004 | Wisler et al. | |
| 6,791,469 | B1 | 9/2004 | Rao et al. | |
| 6,944,547 | B2 * | 9/2005 | Womer et al. | 702/7 |
| 6,958,610 | B2 | 10/2005 | Gianzero | |
| 7,168,508 | B2 | 1/2007 | Goldberg et al. | |
| 7,185,719 | B2 * | 3/2007 | van Riet | 175/66 |
| 7,293,613 | B2 | 11/2007 | Goldberg et al. | |
| 7,350,568 | B2 | 4/2008 | Mandal et al. | |
| 7,500,388 | B2 | 3/2009 | Fujisawa et al. | |
| 7,748,265 | B2 | 7/2010 | Reid et al. | |
| 2002/0112888 | A1 * | 8/2002 | Leuchtenberg | E21B 21/08 175/48 |
| 2002/0169559 | A1 | 11/2002 | Onyia et al. | |
| 2003/0168257 | A1 | 9/2003 | Aldred et al. | |
| 2005/0252286 | A1 | 11/2005 | Ibrahim et al. | |
| 2006/0244455 | A1 | 11/2006 | Bittar | |
| 2007/0168056 | A1 | 7/2007 | Shayegi et al. | |
| 2007/0256832 | A1 * | 11/2007 | Hagiwara et al. | 166/250.16 |
| 2008/0078580 | A1 | 4/2008 | Bittar | |
| 2008/0258733 | A1 | 10/2008 | Bittar | |
| 2008/0297161 | A1 | 12/2008 | Gorek | |
| 2009/0105955 | A1 | 4/2009 | Castillo et al. | |
| 2009/0139768 | A1 | 6/2009 | Castillo | |
| 2009/0150076 | A1 | 6/2009 | Taherian et al. | |
| 2009/0230968 | A1 | 9/2009 | Bittar et al. | |
| 2011/0180327 | A1 | 7/2011 | Bittar et al. | |
| 2011/0290562 | A1 | 12/2011 | Standifird et al. | |
| 2011/0298461 | A1 | 12/2011 | Bittar et al. | |
| 2012/0186873 | A1 | 7/2012 | Shayegi et al. | |

FOREIGN PATENT DOCUMENTS

| | | | |
|---|---|---|---|
| WO | 2010005902 | A2 | 1/2010 |
| WO | 2010050840 | A1 | 5/2010 |
| WO | 2011043851 | A1 | 4/2011 |
| WO | 2011044069 | A1 | 4/2011 |
| WO | 2011090480 | A1 | 7/2011 |

OTHER PUBLICATIONS

International Search Report with Written Opinion issued Nov. 25, 2009 for International Patent Application No. PCT/US09/059541, 8 pages.

International Search Report with Written Opinion issued Nov. 25, 2009 for International Patent Application No. PCT/US09/059545, 8 pages.

International Search Report with Written Opinion issued Feb. 1, 2011 for International Patent Application No. PCT/US10/036851, 9 pages.

Rigzone; "Featured Employer: At Balance", online article, dated 1999-2011, 2 pages.

Schlumberger; "Managed Pressure Drilling & Underbalanced Drilling", online article, dated 2011, 2 pages.

ERC Equipoise; "ERC Equipoise Limited", company information, retrieval date Sep. 9, 2011, 9 pages.

Halliburton; "The Key to Drilling Optimization and Managed Pressure Drilling", Informational article, dated Oct. 2007, 8 pages.

Halliburton; "GeoBalance Optimized Pressure Drilling Services", H06382, dated Jan. 2009, 12 pages.

Specification and Drawings for U.S. Appl. No. 13/659,250, filed Oct. 24, 2012, 30 pages.

Specification and Drawings for U.S. Appl. No. 13/659,273, filed Oct. 24, 2012, 42 pages.

International Search Report with Written Opinion issued Aug. 30, 2012 for PCT Patent Application No. PCT/US11/059947, 9 pages.

International Search Report with Written Opinion issued Aug. 30, 2012 for PCT Patent Application No. PCT/US11/059950, 10 pages.

International Search Report issued Mar. 17, 2010 for PCT Patent Application No. PCT/US10/021715, 1 page.

Halliburton Energy Services, Inc.: "New InSite Generation Resistivity Sensor Combines Geosteering/Formation Evaluation While Drilling to Optimize Wellbore Placement in Complex, Deviated and Horizontal Wells", company article, dated Jul. 2007, 10 pages.

PBORE; "Determined to develope to yield exceptional quality", company brochure, received Sep. 9, 2011, 6 pages.

W. Standifird et al.; "Real-Time Basin Modeling: Improving Geopressure and Earth-Stress Predictions", SPE 96464, dated Sep. 6-9, 2005, 6 pages.

W. Standifird et al.; "New Data Transmission Standard Facilities Synchronous Remote Modeling and Surveillance via the Internet", SPE 99466, dated Apr. 11-13, 2006, 9 pages.

John Jones; "Novel Approach for Estimating Pore Fluid Pressures Ahead of the Drill Bit", SPE/IADC 104606, dated Feb. 20-22, 2007, 13 pages.

Halliburton Energy Services, Inc.; "StressCheck Software", Landmark brochure, H04872, dated Aug. 2006, 4 pages.

Specification for U.S. Appl. No. 13/391,833, filed Feb. 23, 2012, 3 pages.

Drawings for U.S. Appl. No. 13/391,833, filed Feb. 23, 2012, 3 pages.

International Search Report with Written Opinion issued Dec. 3, 2010 for PCT Patent Application No. PCT/US10/051384, 8 pages.

V.A. Akinbinu; "Prediction of fracture gradient from formation pressures and depth using correlation and stepwise multiple regression techniques", Journal of Petroleum Science and Engineering, dated Feb. 16, 2010, 8 pages.

International Preliminary report on Patentability issued Apr. 19, 2012 for PCT Patent Application No. PCT/US10/051384, 7 pages.

W.A. Zoeller; "Pore Pressure Detection From the MWD Gamma Ray", SPE 12166, dated Oct. 5-8, 1983, 12 pages.

Schlumberger, Don Reitsma; "Technical Paper: An Automated System for Accurate and Rapid Detection of Drilling Anomalies", technical paper, No. 140255, IADC Society, dated 2011, 2 pages.

* cited by examiner

INTEGRATED GEOMECHANICS DETERMINATIONS AND WELLBORE PRESSURE CONTROL

CROSS-REFERENCE TO RELATED APPLICATIONS

This application is a national stage application under 35 USC 371 of International Application No. PCT/US 09/59545, filed on Oct 5, 2009. The entire disclosure of this prior application is incorporated herein by this reference.

TECHNICAL FIELD

The present disclosure relates generally to equipment utilized and operations performed in conjunction with a subterranean well and, in an embodiment described herein, more particularly provides well drilling systems and methods with integrated geomechanics determinations and wellbore pressure control.

BACKGROUND

Wellbore pressure control is typically based on pre-drilling assumptions and data from offset wells. Actual conditions in earth formations (e.g., pore pressure, shear failure pressure, fracture pressure and in-situ stress) determined in real time as a well is being drilled have not, however, been taken into consideration in common wellbore pressure control systems. It would be advantageous if a wellbore pressure control system were capable of controlling wellbore pressure based on such real time geomechanics information.

DETAILED DESCRIPTION

Figure 1:
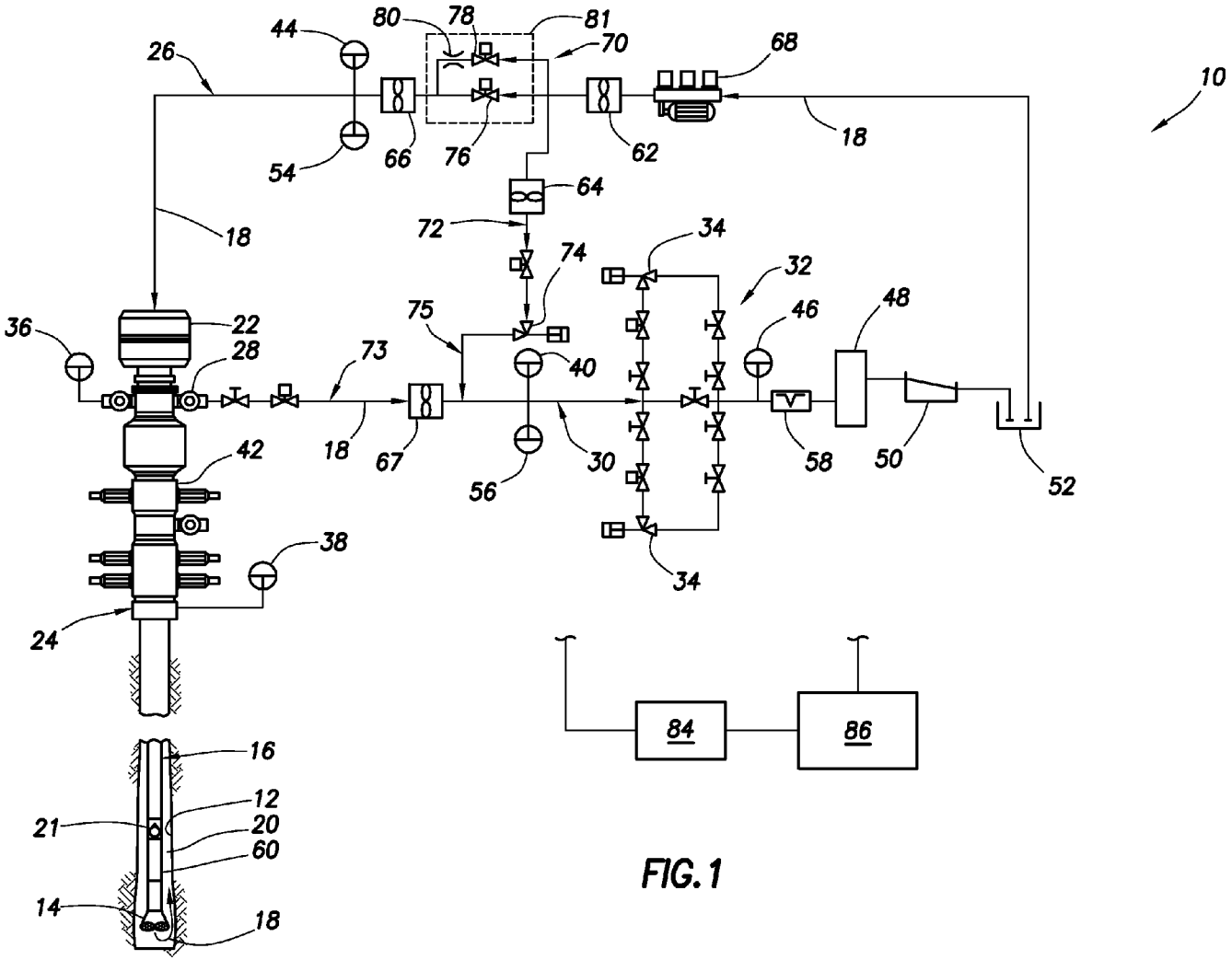
FIG. 1 is a schematic partially cross-sectional view of a well drilling system which can embody principles of the present disclosure.

Representatively and schematically illustrated in FIG. 1 is a well drilling system 10 and associated method which can incorporate principles of the present disclosure. In the system 10, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (e.g., when connections are being made in the drill string).

Control of bottom hole pressure is very important in managed pressure drilling, and in other types of drilling operations. Preferably, the bottom hole pressure is accurately controlled to prevent excessive loss of fluid into the earth formation surrounding the wellbore 12, undesired fracturing of the formation, undesired influx of formation fluids into the wellbore, etc. In typical managed pressure drilling, it is desired to maintain the bottom hole pressure just greater than a pore pressure of the formation, without exceeding a fracture pressure of the formation. In typical underbalanced drilling, it is desired to maintain the bottom hole pressure somewhat less than the pore pressure, thereby obtaining a controlled influx of fluid from the formation.

Nitrogen or another gas, or another lighter weight fluid, may be added to the drilling fluid 18 for pressure control. This technique is useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24.

Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through drilling fluid return lines 30, 73 to a choke manifold 32, which includes redundant flow control devices known as chokes 34 (only one of which may be used at a time). Backpressure is applied to the annulus 20 by variably restricting flow of the fluid 18 through the operative choke(s) 34. The fluid 18 can flow through multiple chokes 34 in parallel, in which case, one of the chokes may be position-controlled (e.g., maintained in a desired flow restricting position), while another choke may be pressure-controlled (e.g., its flow restricting position varied to maintained a desired pressure setpoint, for example, in the annulus 20 at the surface).

The greater the restriction to flow through the choke 34, the greater the backpressure applied to the annulus 20. Thus, bottom hole pressure can be conveniently regulated by varying the backpressure applied to the annulus 20. A hydraulics model can be used to determine a pressure applied to the annulus 20 at or near the surface which will result in a desired bottom hole pressure, so that an operator (or an automated control system) can readily determine how to regulate the pressure applied to the annulus at or near the surface (which can be conveniently measured) in order to obtain the desired bottom hole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the drilling fluid return lines 30, 73 upstream of the choke manifold 32.

Another pressure sensor 44 senses pressure in the drilling fluid injection (standpipe) line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66.

Not all of these sensors are necessary. For example, the system 10 could include only two of the three flowmeters 62, 64, 66. However, input from the sensors is useful to the hydraulics model in determining what the pressure applied to the annulus 20 should be during the drilling operation.

Furthermore, the drill string 16 preferably includes at least one sensor 60. Such sensor(s) 60 may be of the type known to those skilled in the art as pressure while drilling (PWD), measurement while drilling (MWD) and/or logging while drilling (LWD) systems. These drill string sensor systems generally provide at least pressure measurement, and may also provide temperature measurement, detection of drill string characteristics (such as vibration, torque, rpm, weight on bit, stick-slip, etc.), formation characteristics (such as resistivity, density, etc.), fluid characteristics and/or other measurements.

The sensor 60 may be capable of measuring one or more properties of a portion of a formation prior to the drill bit 14 cutting into that portion of the formation. For example, the sensor 60 may measure a property of an earth formation approximately 10 to 50 feet (~3 to 17 meters) ahead of the bit 14. More advanced sensors may be capable of measuring a property of an earth formation up to about 100 feet (~30 meters) ahead of the bit 14. However, it should be understood that measurement of formation properties at any distance ahead of the bit 14 may be used, in keeping with the principles of this disclosure.

Suitable resistivity sensors which may be used for the sensor 60 are described in U.S. Pat. Nos. 7,557,580 and 7,427,863. A suitable sensor capable of being used to measure resistivity of an earth formation ahead of a drill bit is described in the international patent application filed on the same date herewith, having Michael S. Bittar and Burkay Donderici as inventors thereof, and entitled Deep Evaluation of Resistive Anomalies in Borehole Environments (agent file reference 09-021339).

Various forms of telemetry (acoustic, pressure pulse, electromagnetic, etc.) may be used to transmit the downhole sensor measurements to the surface. Alternatively, or in addition, the drill string 16 may comprise wired drill pipe (e.g., having electrical conductors extending along the length of the drill pipe) for transmitting data and command signals between downhole and the surface or another remote location.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc. Pressure and level sensors could be used with the separator 48, level sensors could be used to indicate a volume of drilling fluid in the mud pit 52, etc.

Fewer sensors could be included in the system 10, if desired. For example, the output of the rig mud pump 68 could be determined by counting pump strokes, instead of by using flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 70 to the standpipe 26, the fluid then circulates downward through the drill string 16, upward through the annulus 20, through the drilling fluid return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the bottom hole pressure, unless the fluid 18 is flowing through the choke. In conventional overbalanced drilling operations, such a situation will arise whenever a connection is made in the drill string 16 (e.g., to add another length of drill pipe to the drill string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string. Thus, pressure can still be applied to the annulus 20 by restricting flow of the fluid 18 through the choke 34, even though a separate back-pressure pump may not be used.

Instead, the fluid 18 is flowed from the pump 68 to the choke manifold 32 via a bypass line 72, 75 when a connection is made in the drill string 16. Thus, the fluid 18 can bypass the standpipe line 26, drill string 16 and annulus 20, and can flow directly from the pump 68 to the mud return line 30, which remains in communication with the annulus 20. Restriction of this flow by the choke 34 will thereby cause pressure to be applied to the annulus 20.

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20.

Although this might require some additional plumbing at the rig site, the effect on the annulus pressure would be essentially the same as connecting the bypass line 75 and the mud return line 30 to the common line 73. Thus, it should be appreciated that various different configurations of the components of the system 10 may be used, without departing from the principles of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe line 26 is substantially controlled by a valve or other type of flow control device 76. Note that the flow control devices 74, 76 are independently controllable, which provides substantial benefits to the system 10, as described more fully below.

Since the rate of flow of the fluid 18 through each of the standpipe and bypass lines 26, 72 is useful in determining how bottom hole pressure is affected by these flows, the flowmeters 64, 66 are depicted in FIG. 1 as being interconnected in these lines. However, the rate of flow through the standpipe line 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

A bypass flow control device 78 and flow restrictor 80 may be used for filling the standpipe line 26 and drill string 16 after a connection is made, and equalizing pressure between the standpipe line and mud return lines 30, 73 prior to opening the flow control device 76. Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe line and drill string fill with fluid, etc.).

By opening the standpipe bypass flow control device 78 after a connection is made, the fluid 18 is permitted to fill the standpipe line 26 and drill string 16 while a substantial majority of the fluid continues to flow through the bypass line 72, thereby enabling continued controlled application of pressure to the annulus 20. After the pressure in the standpipe line 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe line 26.

Before a connection is made in the drill string 16, a similar process can be performed, except in reverse, to gradually divert flow of the fluid 18 from the standpipe line 26 to the bypass line 72 in preparation for adding more drill pipe to the drill string 16. That is, the flow control device 74 can be gradually opened to slowly divert a greater proportion of the fluid 18 from the standpipe line 26 to the bypass line 72, and then the flow control device 76 can be closed.

Note that the flow control device 78 and flow restrictor 80 could be integrated into a single element (e.g., a flow control device having a flow restriction therein), and the flow control devices 76, 78 could be integrated into a single flow control device 81 (e.g., a single choke which can gradually open to slowly fill and pressurize the standpipe line 26 and drill string 16 after a drill pipe connection is made, and then open fully to allow maximum flow while drilling).

However, since typical conventional drilling rigs are equipped with the flow control device 76 in the form of a valve in the standpipe manifold 70, and use of the standpipe valve is incorporated into usual drilling practices, the individually operable flow control devices 76, 78 are presently preferred. The flow control devices 76, 78 are at times referred to collectively below as though they are the single flow control device 81, but it should be understood that the flow control device 81 can include the individual flow control devices 76, 78.

Note that the system 10 could include a backpressure pump (not shown) for applying pressure to the annulus 20 and drilling fluid return line 30 upstream of the choke manifold 32, if desired. The backpressure pump could be used instead of, or in addition to, the bypass line 72 and flow control device 74 to ensure that fluid continues to flow through the choke manifold 32 during events such as making connections in the drill string 16. In that case, additional sensors may be used to, for example, monitor the pressure and flow rate output of the backpressure pump.

In other examples, connections may not be made in the drill string 16 during drilling, for example, if the drill string comprises a coiled tubing. The drill string 16 could be provided with conductors and/or other lines (e.g., in a sidewall or interior of the drill string) for transmitting data, commands, pressure, etc. between downhole and the surface (e.g., for communication with the sensor 60).

Pressure in the wellbore 12 can also be controlled (whether or not connections are made in the drill string 16) by adjusting flow in the annulus 20 by varying a flow rate from the rig mud pump 68 into the drill string 16, varying a flow rate of fluid pumped into the annulus 20 (such as, via the backpressure pump described above and/or via the bypass line 75), adjusting flow through a flow sub (not shown) in the drill string 16, and adjusting flow through a parasite string or a concentric casing (not shown) into the annulus 20.

As depicted in FIG. 1, a controller 84 (such as a programmable logic controller or another type of controller capable of controlling operation of drilling equipment) is connected to a control system 86 (such as the control system described in international application serial no. PCT/US08/87686). The controller 84 is also connected to the flow control devices 34, 74, 81 for regulating flow injected into the drill string 16, flow through the drilling fluid return line 30, and flow between the standpipe injection line 26 and the return line 30.

The control system 86 can include various elements, such as one or more computing devices/processors, a hydraulic model, a wellbore model, a database, software in various formats, memory, machine-readable code, etc. These elements and others may be included in a single structure or location, or they may be distributed among multiple structures or locations.

The control system 86 is connected to the sensors 36, 38, 40, 44, 46, 54, 56, 58, 60, 62, 64, 66, 67 which sense respective drilling properties during the drilling operation. As discussed above, offset well data, previous operator experience, other operator input, etc. may also be input to the control system 86. The control system 86 can include software, programmable and preprogrammed memory, machine-readable code, etc. for carrying out the steps of the methods described herein.

The control system 86 may be located at the wellsite, in which case the sensors 36, 38, 40, 44, 46, 54, 56, 58, 60, 62, 64, 66, 67 could be connected to the control system by wires or wirelessly. Alternatively, the control system 86, or any portion of it, could be located at a remote location, in which case the control system could receive data via satellite transmission, the Internet, wirelessly, or by any other appropriate means. The controller 84 can also be connected to the control system 86 in various ways, whether the control system is locally or remotely located.

In one example, data signals from the sensors 36, 38, 40, 44, 46, 54, 56, 58, 60, 62, 64, 66, 67 are transmitted to the control system 86 at a remote location, the data is analyzed there (e.g., utilizing computing devices/processors, a hydraulic model, a wellbore model, a database, software in various formats, memory, and/or machine-readable code, etc.) at the remote location. The wellbore model preferably includes a geomechanics model for determining properties of the formation surrounding the wellbore 12, ahead of the bit 14, etc. A decision as to how to proceed in the drilling operation (such as, whether to vary any of the drilling parameters) may be made automatically based on this analysis, or human intervention may be desirable in some situations.

Instructions as to how to proceed are then transmitted as signals to the controller 84 for execution at the wellsite. Even though all or part of the control system 86 may be at a remote location, the drilling parameter can still be varied in real time in response to measurement of properties of the formation, since modern communication technologies (e.g., satellite transmission, the Internet, etc.) enable transmission of signals without significant delay.

In the system 10, the control system 86 preferably determines pore pressure, shear failure pressure, fracture pressure and in-situ stress about the wellbore 12 (including ahead of the bit 14) in real time as the wellbore is being drilled. In this manner, wellbore pressure can be optimized, for example, to prevent undesired fluid influxes from the surrounding formation into the wellbore 12, to prevent shear failure and wellbore collapse, to prevent or minimize wellbore ballooning, and to prevent undesired hydraulic fracturing and fluid loss from the wellbore to the surrounding formation.

The determination of pore pressure, shear failure pressure, fracture pressure and in-situ stress is preferably based on the data received by the control system 86 from some or all of the sensors 36, 38, 40, 44, 46, 54, 56, 58, 60, 62, 64, 66, 67. This data can be used to update and refine the hydraulics and wellbore models of the control system 86 in real time, so that the wellbore pressure can be controlled in real time based on the latest available data, rather than based on pre-drilling assumptions, offset well data, etc.

Figure 2B:
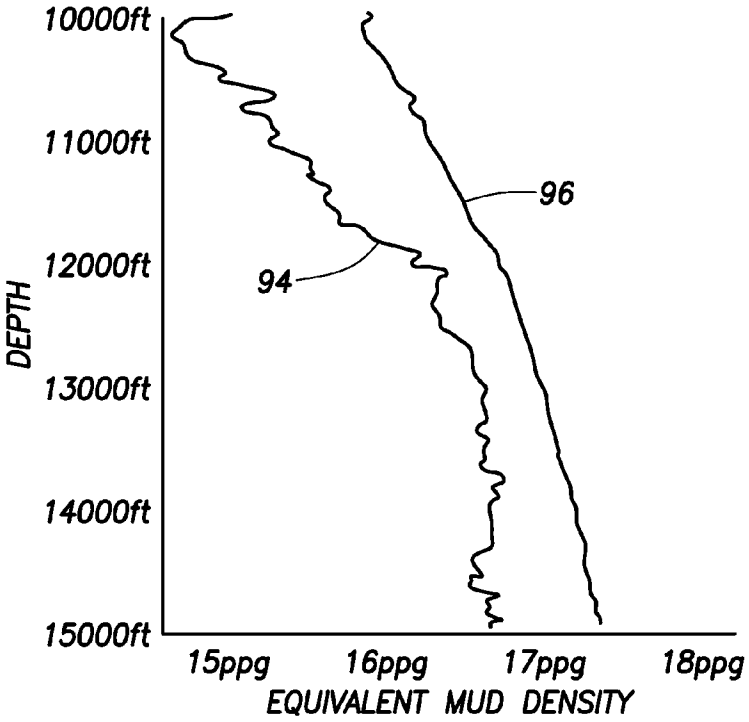
FIGS. 2A & B are representative graphs of pore pressure and fracture pressure versus depth, FIG. 2A being representative of pre-drilling prediction, and FIG. 2B being representative of actual real time determination of these formation properties.
Figure 2A:
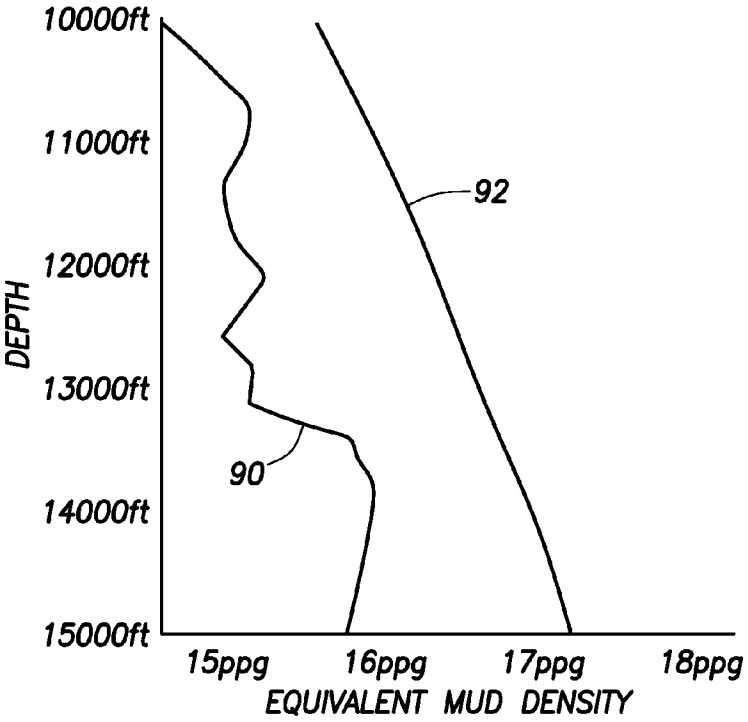

For example, a pre-drilling prediction might result in expected pore pressure and fracture pressure curves 90, 92 as depicted in FIG. 2A, whereas the actual pore pressure and fracture pressure curves 94, 96 could turn out to be as depicted in FIG. 2B. In the example of FIGS. 2A & B, an operator could make an erroneous decision (such as, where to set casing, etc.) based on an expected margin between pore and fracture pressures 90, 92 at a particular depth, only to find out that the margin is actually much less than what was predicted based on the pre-drilling assumptions, offset well data, etc. If wellbore pressure control is based on inaccurate predictions of pore pressure, shear failure pressure, fracture pressure, in-situ stress, etc., then the problems of fluid influx, shear failure, wellbore collapse, ballooning and/or hydraulic fracturing can occur.

However, based on the principles described in this disclosure, the actual pore pressure, shear failure pressure, fracture pressure and in-situ stress can be determined in real time as the wellbore 12 is being drilled, and the wellbore pressure can be controlled in real time based on the actual properties of the formation surrounding the wellbore, so that drilling problems can be avoided. This will result in greater efficiency and increased production.

It should be clearly understood, however, that in other embodiments, modeled predictions of geomechanical properties ahead of the bit 14 may be used for wellbore pressure control purposes, with or without having additional actual measurement of properties ahead of the bit. Furthermore, predictions of geomechanical properties ahead of the bit 14, with those predictions being constrained by actual measurements at and behind the bit, may be used for wellbore pressure control purposes.

In one example, the wellbore pressure could be controlled automatically in real time based on the determinations of pore pressure, shear failure pressure, fracture pressure and in-situ stress. The control system 86 could, for example, be programmed to maintain the wellbore pressure at 25 psi (~172 kpa) greater than the maximum pore pressure of the formation exposed to the wellbore 12. As the wellbore 12 is being drilled, the actual pore pressure curve 94 is continuously (or at least periodically) updated and, as a result, the wellbore pressure is also continuously varied as needed to maintain the desired margin over pore pressure.

The control system 86 could also, or alternatively, be programmed to maintain a desired margin less than fracture pressure, greater than shear failure pressure, etc. An alarm could be activated whenever one of the margins is not present and, although the system could be entirely automated, human intervention could be interposed as appropriate.

The control system 86 supplies a pressure setpoint to the controller 84, which operates the flow control devices 34, 74, 81 as needed to achieve or maintain the desired wellbore pressure. The setpoint will vary over time, as the determinations of actual pore pressure, shear failure pressure, fracture pressure and in-situ stress are updated.

For example, using the hydraulic model and wellbore model of the control system 86, along with the latest data obtained from the sensors 36, 38, 40, 44, 46, 54, 56, 58, 60, 62, 64, 66, 67, it may be determined that a pressure of 500 psi (~3445 kpa) should be in the annulus 20 at the surface to produce a desired bottom hole pressure. The controller 84 can operate the flow control devices 34, 74, 81 as needed to achieve and maintain this desired annulus pressure.

If the sensor 60 is capable of transmitting real time or near-real time bottom hole pressure measurements, then the controller 84 can operate the flow control devices 34, 74, 81 as needed to achieve and maintain a desired bottom hole pressure as determined by the control system 86. The annulus pressure setpoint or bottom hole pressure setpoint will be continuously (or at least periodically) updated in real time using the hydraulic model and wellbore model of the control system 86, along with the latest data obtained from the sensors 36, 38, 40, 44, 46, 54, 56, 58, 60, 62, 64, 66, 67.

Figure 3:
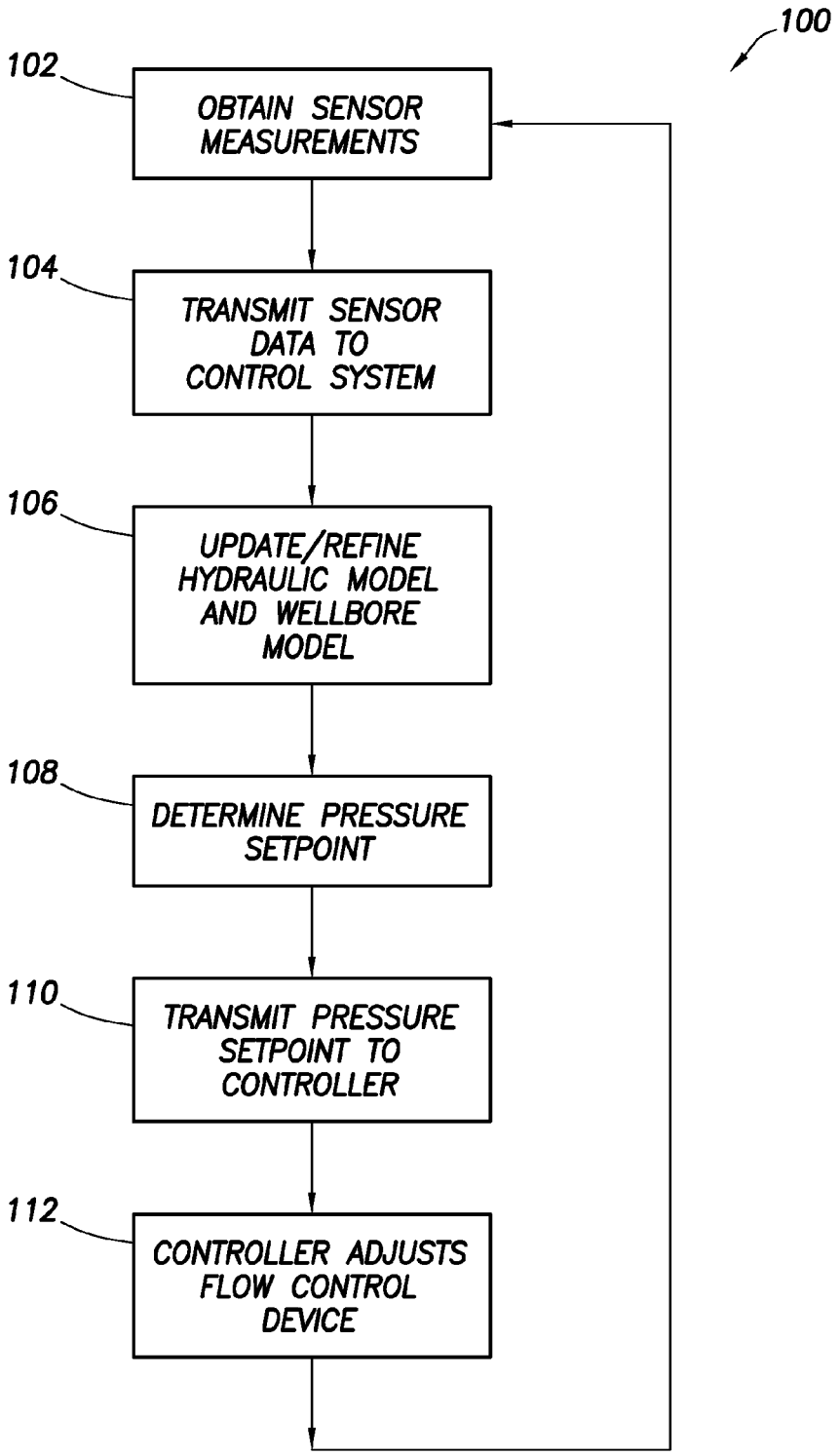
FIG. 3 is a schematic flowchart of a method embodying principles of this disclosure.

Referring additionally now to FIG. 3, a well drilling method 100 is representatively illustrated in flowchart form. The method 100 may be used with the system 10 as described above, or the method may be used with other well drilling systems (such as conventional drilling systems, underbalanced drilling systems, managed pressure drilling systems, etc.).

The steps 102-112 of the method 100 are depicted in FIG. 3 as following one another in a continuous cycle. However, it should be clearly understood that the method 100 can include more or less steps than those depicted in FIG. 3, the steps can be performed in a different order, and it is not necessary for any particular step to follow any other particular step, in keeping with the principles of this disclosure.

In step 102, sensor measurements are obtained. These measurements may be obtained from any of the sensors 36, 38, 40, 44, 46, 54, 56, 58, 60, 62, 64, 66, 67 described above, or any combination of these or other sensors.

In step 104, sensor data is transmitted to the control system 86. As discussed above, the control system 86 could be located at the wellsite, or any portion of the control system could be located at a remote location. Data and command signals can be transmitted between the remote location and the wellsite via any communication medium (e.g., satellite transmission, the Internet, wired or wireless communication, etc.).

One advantage of transmitting the data to a remote location is that a person at the remote location does not have to be present at the wellsite. Another advantage is that a person at the remote location can monitor data received from multiple wellsites, and so multiple persons are not needed for monitoring data at respective multiple wellsites. If the person at the remote location has specialized knowledge (such as, if the person is a well control expert), that knowledge can be available for decision making as needed for the multiple drilling operations at the respective multiple wellsites.

In step 106, the hydraulic model and wellbore model of the control system 86 are updated and/or refined based on the most recent sensor data. Preferably, the hydraulic and wellbore models are updated in real time based on real time sensor data.

In step 108, a pressure setpoint is determined by the control system 86 using the updated/refined hydraulic model and wellbore model. The setpoint could be a desired pressure in the annulus 20 at the surface or a desired bottom hole pressure, as described above, or any other desired pressure.

In step 110, the pressure setpoint is transmitted to the controller 84. If the pressure setpoint is determined at a remote location, then the pressure setpoint may be transmitted to the controller 84 at the wellsite by various means (such as, satellite transmission, the Internet, wired or wireless communication, etc.).

In step 112, the controller 84 adjusts one or more of the flow control devices 34, 74, 81 as needed to achieve or maintain the desired wellbore pressure (i.e., to influence the wellbore pressure toward the pressure setpoint). For example, flow through the choke 34 can be increasingly restricted to increase wellbore pressure, or flow through the choke can be less restricted to decrease wellbore pressure.

Each of the steps 102-112 can be performed at any time, or continuously or periodically, in the method 100. For example, the controller 84 will continually adjust one or more of the flow control devices 34, 74, 81 as needed to maintain pressure in the annulus 20 or bottom hole pressure according to the last setpoint pressure, even though a new updated pressure setpoint may only periodically be transmitted to the controller by the control system 86. As another example, the hydraulic and wellbore models may be updated only when new sensor data is received, although sensor data may be continuously transmitted to the control system 86, if desired.

It may now be fully appreciated that the systems and methods described above provide many advancements to the art of well drilling. Instead of relying on pre-drilling predictions of formation properties such as pore pressure and fracture pressure, the formation properties can be updated in real time, and can be used for real time control of wellbore pressures.

The above disclosure provides a well drilling method 100 which includes updating determinations of properties of a formation surrounding a wellbore 12 in real time as the wellbore 12 is being drilled; and controlling wellbore pressure in real time as the wellbore 12 is being drilled, in response to the updated determinations of the formation properties.

At least one of the updating and controlling steps may be performed at a location remote from a wellsite where the wellbore 12 is being drilled.

The step of controlling wellbore pressure may be performed automatically in response to the updating of the determinations of formation properties.

The updating of determinations of formation properties may be performed at least periodically as the wellbore 12 is being drilled. The updating of determinations of formation properties may be performed continuously as the wellbore 12 is being drilled.

Controlling the wellbore pressure may include controlling operation of at least one flow control device 34, 74, 81. The flow control device 34 may be interconnected in a mud return line 30.

The updating of determinations of formation properties may be performed in response to receiving sensor measurements (e.g., from sensors 36, 38, 40, 44, 46, 54, 56, 58, 60, 62, 64, 66, 67) in real time as the wellbore 12 is being drilled. The sensor measurements may include at least one ahead of bit 14 measurement.

The updating of determinations of formation properties may include producing a curve 94 of actual pore pressure versus depth along the wellbore 12 as the wellbore 12 is being drilled. The updating of determinations of formation properties may include producing a curve 96 of actual fracture pressure versus depth along the wellbore 12 as the wellbore 12 is being drilled.

Also described above is the well drilling method 100 which includes obtaining sensor measurements in a well drilling system 10 in real time as a wellbore 12 is being drilled; transmitting the sensor measurements to a control system 86 in real time; the control system 86 determining in real time properties of a formation surrounding the wellbore 12 based on the sensor measurements, and the control system transmitting in real time a pressure setpoint to a controller 84; and the controller 84 controlling operation of at least one flow control device 34, 74, 81, thereby influencing a well pressure toward the pressure setpoint.

Sensor measurements obtaining, sensor measurements transmitting, formation properties determining, pressure setpoint transmitting and controlling operation of the flow control device 34, 74, 81 may be performed at least periodically during drilling of the wellbore 12. Sensor measurements obtaining, sensor measurements transmitting, formation properties determining, pressure setpoint transmitting and controlling operation of the flow control device 34, 74, 81 may be performed continuously during drilling of the wellbore 12.

The well pressure may be pressure in an annulus 20 between the wellbore 12 and a drill string 16 being used to drill the wellbore 12. The well pressure may be pressure at a bottom of the wellbore 12.

Determining the formation properties may include determining at least pore pressure in the formation.

Determining the formation properties may include determining at least pore pressure, shear failure pressure and in-situ stress in the formation.

The formation properties determining may include producing a curve 94 of actual pore pressure versus depth along the wellbore 12 as the wellbore 12 is being drilled. The formation properties determining may include producing a curve 96 of actual fracture pressure versus depth along the wellbore 12 as the wellbore 12 is being drilled.

Controlling operation of the flow control device may include adjusting flow restriction through a choke 34 interconnected in a mud return line 30.

Controlling operation of at least one flow control device may include at least one of: adjusting flow in an annulus 20 in the wellbore by varying a flow rate from a mud pump 68 into a drill string 16, varying a flow rate of fluid pumped into the annulus 20, adjusting flow through a flow sub in the drill string 16, and adjusting flow through a parasite string or a concentric casing into the annulus 20.

It is to be understood that the various embodiments of the present disclosure described above may be utilized in various orientations, with various types of wellbores and well drilling systems, and in various configurations, without departing from the principles of this disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well drilling method, comprising:

determining a property of a formation surrounding a wellbore in real time as the wellbore is being drilled, wherein the determining is based at least in part on data received from a sensor located at a surface location; and controlling wellbore pressure in real time as the wellbore is being drilled by controlling operation of a flow control device independently from a mud pump, the flow control device interconnected in a mud return line returning mud from the wellbore.

2. The method of claim 1, wherein at least one of the determining and the controlling is performed at a location remote from a wellsite where the wellbore is being drilled.

3. The method of claim 1, wherein the controlling is performed automatically in response to the determining.

4. The method of claim 1, wherein the determining is performed at least repeatedly as the wellbore is being drilled.

5. The method of claim 1, wherein the determining is performed continuously as the wellbore is being drilled.

6. The method of claim 1, wherein the determining is performed in response to receiving a measurement from at least one of the surface sensor and a downhole sensor in real time as the wellbore is being drilled.

7. The method of claim 6, wherein the measurement includes an ahead of bit measurement received from the downhole sensor.

8. The method of claim 1, wherein the determining includes producing a curve of actual pore pressure versus depth along the wellbore as the wellbore is being drilled.

9. The method of claim 1, wherein the determining includes producing a curve of actual fracture pressure versus depth along the wellbore as the wellbore is being drilled.

10. A well drilling method, comprising:

obtaining a sensor measurement from a surface sensor located at a surface location in a well drilling system in real time as a wellbore is being drilled;

transmitting the sensor measurement to a control system in real time;

the control system determining in real time a property of a formation surrounding the wellbore based on the sensor measurement;

the control system transmitting in real time a pressure setpoint to a controller, wherein the pressure setpoint is based on the determined property of the formation; and the controller controlling operation of a flow control device independently from a mud pump, the flow control device interconnected in a mud return line returning mud from the wellbore, thereby influencing a well pressure toward the pressure setpoint.

11. The method of claim 10, wherein the obtaining, the transmitting the sensor measurement, the determining, the transmitting the pressure setpoint and the controlling are performed at least repeatedly during drilling of the wellbore.

12. The method of claim 10, wherein the obtaining, the transmitting the sensor measurement, the determining, the transmitting the pressure setpoint and the controlling are performed continuously during drilling of the wellbore.

13. The method of claim 10, wherein the well pressure is pressure in an annulus between the wellbore and a drill string being used to drill the wellbore.

14. The method of claim 10, wherein the well pressure is pressure at a bottom of the wellbore.

15. The method of claim 10, wherein the determining includes producing a curve of actual pore pressure versus depth along the wellbore as the wellbore is being drilled.

16. The method of claim 10, wherein the determining includes producing a curve of actual fracture pressure versus depth along the wellbore as the wellbore is being drilled.

17. The method of claim 10, wherein the controlling includes adjusting flow restriction through a choke interconnected in a mud return line.

18. The method of claim 10, wherein the controlling includes at least one of: adjusting flow in an annulus in the wellbore by varying a flow rate from a mud pump into a drill string, varying a flow rate of fluid pumped into the annulus, and adjusting flow through a flow sub in the drill string.

* * * * *